US006962032B2

(12) United States Patent
Scarabelli et al.

(10) Patent No.: US 6,962,032 B2
(45) Date of Patent: Nov. 8, 2005

(54) PACKAGING MACHINE FOR CONTINUOUSLY PRODUCING SEALED PACKAGES

(75) Inventors: Paolo Scarabelli, Sesso (IT); Frank-Mario Schellenberg, Hochheim (DE); Lorenzo Tacconi, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/312,850

(22) PCT Filed: Jul. 2, 2001

(86) PCT No.: PCT/EP01/07548

§ 371 (c)(1),
(2), (4) Date: Jan. 2, 2003

(87) PCT Pub. No.: WO02/02407

PCT Pub. Date: Jan. 10, 2002

(65) Prior Publication Data

US 2003/0101684 A1 Jun. 5, 2003

(30) Foreign Application Priority Data

Jul. 3, 2000 (EP) ..... 00830462

(51) Int. Cl.[7] ..... B65B 57/00
(52) U.S. Cl. ..... 53/52
(58) Field of Search ..... 53/450, 451, 550, 53/551, 52, 505, 65, 393

(56) References Cited

U.S. PATENT DOCUMENTS

| | | | |
|---|---|---|---|
| 3,263,391 | A | 8/1966 | Wallsten |
| 3,463,679 | A | 8/1969 | Weeton et al. |
| 3,699,743 | A | 10/1972 | King et al. |
| 3,726,058 | A | 4/1973 | Stark |
| 3,738,080 | A | 6/1973 | Reil |
| 3,785,113 | A | 1/1974 | Martensson et al. |
| 3,788,033 | A | 1/1974 | Martensson et al. |
| 3,789,746 | A | 2/1974 | Martensson et al. |
| 3,820,303 | A | 6/1974 | Martensson et al. |
| 3,830,140 | A | 8/1974 | Rausing et al. |
| 3,884,012 | A | 5/1975 | Ernstsson et al. |
| 3,911,640 | A | 10/1975 | Rausing |
| 3,911,642 | A | 10/1975 | Ernstsson et al. |
| 3,918,237 | A | 11/1975 | Stark et al. |
| 3,922,835 | A | 12/1975 | Reil |
| 4,014,158 | A | 3/1977 | Rausing |
| 4,017,247 | A | 4/1977 | Soukup et al. |
| 4,027,455 | A | 6/1977 | Rausing et al. |
| 4,062,712 | A | 12/1977 | Stark |
| 4,074,961 | A | 2/1978 | Reil |
| 4,077,829 | A | 3/1978 | Pupp et al. |
| 4,081,944 | A | 4/1978 | Sjöstrand |
| 4,094,124 | A | 6/1978 | Ljungcrantz |
| 4,132,051 | A | 1/1979 | Rausing |
| 4,151,024 | A | 4/1979 | Ohlsson |

(Continued)

*Primary Examiner*—John Paradiso
(74) *Attorney, Agent, or Firm*—Burns, Doane, Swecker & Mathis, L.L.P.

(57) ABSTRACT

There is described a packaging machine (1) for producing sealed packages (2) of a pourable food product from a strip (6) of heat-seal sheet packaging material. The packaging material (1) has a number of photocells (14), which are programmable externally as regards their setting parameters, are positioned facing the strip (6) of packaging material to detect optically detectable elements on the strip, and have setting means (26, 210, 300). The packaging machine (1) also has a control unit (16) connected to the photocells (14) and having enabling means (24) for enabling the setting means of a specific photocell (14), data downloading means (26, 240, 310) for downloading off the specific photocell (14) the setting parameters of the photocell, and data uploading means (26, 260, 330) for uploading onto the other photocells (14) setting parameters calculated as a function of the setting parameters downloaded off the specific photocell (14).

29 Claims, 3 Drawing Sheets

U.S. PATENT DOCUMENTS 4,196,035 A 4/1980 Reil
4,203,795 A 5/1980 Pupp et al.
4,203,796 A 5/1980 Larsson
4,293,369 A 10/1981 Dilot et al.
4,345,415 A 8/1982 Järund
4,371,364 A 2/1983 Rausing
4,372,797 A 2/1983 Dilot et al.
4,379,014 A 4/1983 Rausing et al.
4,384,438 A 5/1983 Hilmersson
4,384,440 A 5/1983 Ohlsson
4,384,441 A 5/1983 Maruyama et al.
4,384,915 A 5/1983 Utsumi
4,387,547 A 6/1983 Reil
4,430,140 A 2/1984 Pupp et al.
4,437,498 A 3/1984 Pankratz et al.
4,448,008 A 5/1984 Pankratz et al.
4,462,202 A 7/1984 Reil
4,484,977 A 11/1984 Andersson
4,510,732 A 4/1985 Löthman
4,528,803 A 7/1985 Ott
4,546,592 A 10/1985 Reil
4,580,392 A 4/1986 Lagerstedt et al.
4,608,810 A 9/1986 Bordini
4,617,779 A 10/1986 Nygren et al.
4,641,486 A 2/1987 Zannoni
4,646,507 A 3/1987 Ohlsson et al.
4,759,171 A 7/1988 Bruveris et al.
4,759,695 A 7/1988 Bordini
4,782,987 A 11/1988 Giacomelli et al.
4,784,697 A 11/1988 Bordiini
4,790,123 A 12/1988 Ljungström et al.
4,971,087 A 11/1990 Benedetti et al.
5,142,843 A 9/1992 Reil et al.
5,155,980 A 10/1992 Mansson et al.
5,201,163 A 4/1993 Reil et al.
5,464,497 A 11/1995 Unthank
5,469,690 A 11/1995 Nordell
5,487,253 A 1/1996 Hieltscher et al.
5,488,812 A 2/1996 Stark et al.
5,494,691 A 2/1996 Sizer
5,522,438 A 6/1996 Gustafsson et al.
5,537,803 A 7/1996 Olsén
5,548,944 A 8/1996 Prochut et al.
5,555,702 A 9/1996 Sizer
5,599,268 A 2/1997 Anderson et al.
5,966,899 A 10/1999 Fontanazzi
6,035,604 A 3/2000 Gustafsson
6,035,615 A 3/2000 Hansson et al.
6,038,838 A 3/2000 Fontanazzi
6,085,495 A 7/2000 Fontanazzi et al.
6,085,496 A 7/2000 Fontanazzi et al.
6,109,420 A 8/2000 Poppi et al.
6,112,498 A 9/2000 Hansson et al.
6,192,660 B1 2/2001 Moriyama et al.
6,199,685 B1 3/2001 Fontanazzi
6,256,964 B1 7/2001 Drevfors
6,397,557 B1 6/2002 Bassissi et al.
6,460,748 B1 10/2002 Boschi
6,484,478 B1 * 11/2002 Arends et al. ..... 53/544
2003/0047475 A1 * 3/2003 Arends et al. ..... 206/427

* cited by examiner

PACKAGING MACHINE FOR CONTINUOUSLY PRODUCING SEALED PACKAGES

FIELD OF THE INVENTION

The present invention relates to a packaging machine for continuously producing sealed packages of a pourable food product and featuring programmable photocells.

BACKGROUND OF THE INVENTION

Many pourable food products, such as fruit juice, UHT milk, wine, tomato sauce, etc., are sold in packages made of sterilized packaging material.

A typical example of such a package is the parallelepiped-shaped package for liquid or pourable food products known as Tetra Brik or Tetra Brik Aseptic (registered trademarks), which is formed by folding and sealing laminated strip packaging material.

The packaging material has a multilayer structure comprising a layer of fibrous material, e.g. paper, covered on both sides with layers of heat-seal plastic material, e.g. polyethylene.

In the case of aseptic packages for long-storage products, such as UHT milk, the packaging material also comprises a layer of barrier material defined, for example, by an aluminium film, which is superimposed on a layer of heat-seal plastic material and is in turn covered with another layer of heat-seal plastic material eventually defining the inner face of the package contacting the food product.

As is known, such packages are made on fully automatic packaging machines, on which a continuous tube is formed from the packaging material supplied in strip form; and the strip of packaging material is sterilized on the packaging machine, e.g. by applying a chemical sterilizing agent, such as a hydrogen peroxide solution.

After sterilization, the sterilizing agent is removed, e.g. vaporized by heating, from the surfaces of the packaging material; and the strip of packaging material so sterilized is maintained in a closed sterile environment, and is folded and sealed longitudinally to form a tube.

The tube is filled with the sterilized or sterile-processed food product, and is sealed and cut at equally spaced cross sections to form pillow packs, which are then folded mechanically to form the finished, e.g. substantially parallelepiped-shaped, packages.

Along the path of the strip of packaging material, packaging machines of the above type normally comprise a number of photocells facing, and for detecting the passage of optically detectable elements on, the strip, e.g. optical register or reference codes, in particular bar codes, printed on the strip.

The photocells are connected to a control unit for controlling the packaging machine, and which acquires the signals generated by the photocells and, in known manner, accordingly enables the performance of specific operations on the strip of packaging material.

Photocells currently available on the market are also self-setting to adapt to specific operating conditions, by implementing a teach-in procedure, which can be enabled either in local mode—i.e. by the operator pressing a button on the photocell—or in centralized or remote mode—i.e. by means of an enable signal from the control unit to an input on the photocell.

The teach-in procedure requires that a register code be fed past each photocell, which is done manually by the operator either feeding the strip of packaging material past each photocell, or using a register code impressed on a separate sheet of paper.

The teach-in procedure provides for automatically setting photocell operating parameters such as: light spot color (red, green, blue) used to detect passage of the register code on the strip of packaging material and static intervention threshold.

Though extremely advantageous costwise, photocells of the above type, when used on packaging machines, pose several drawbacks preventing full use of the advantages available.

In particular, local mode enabling the teach-in procedure of each individual photocell takes a relatively long time, on account of both the large number of photocells involved and the actual location of the photocells, which, on packaging machines, are not always easily accessible by the operator.

Though faster than local mode, centralized enabling of the teach-in procedure is also far from negligible by still involving a fairly considerable amount of downtime.

SUMMARY OF THE INVENTION

It is an object of the present invention to provide a packaging machine for continuously producing sealed packages of a pourable food product and featuring photocells designed to eliminate the aforementioned drawbacks.

It is a further object of the present invention to provide a method of setting of photocells on a packaging machine for continuously producing sealed packages of a pourable food product, designed to eliminate the aforementioned drawbacks.

According to the present invention, there is provided a packaging machine for producing sealed packages of a pourable food product, as claimed in claim 1.

According to the present invention, there is also provided a method of setting of a photocell on a packaging machine for producing sealed packages of a pourable food product, as claimed in claim 9.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
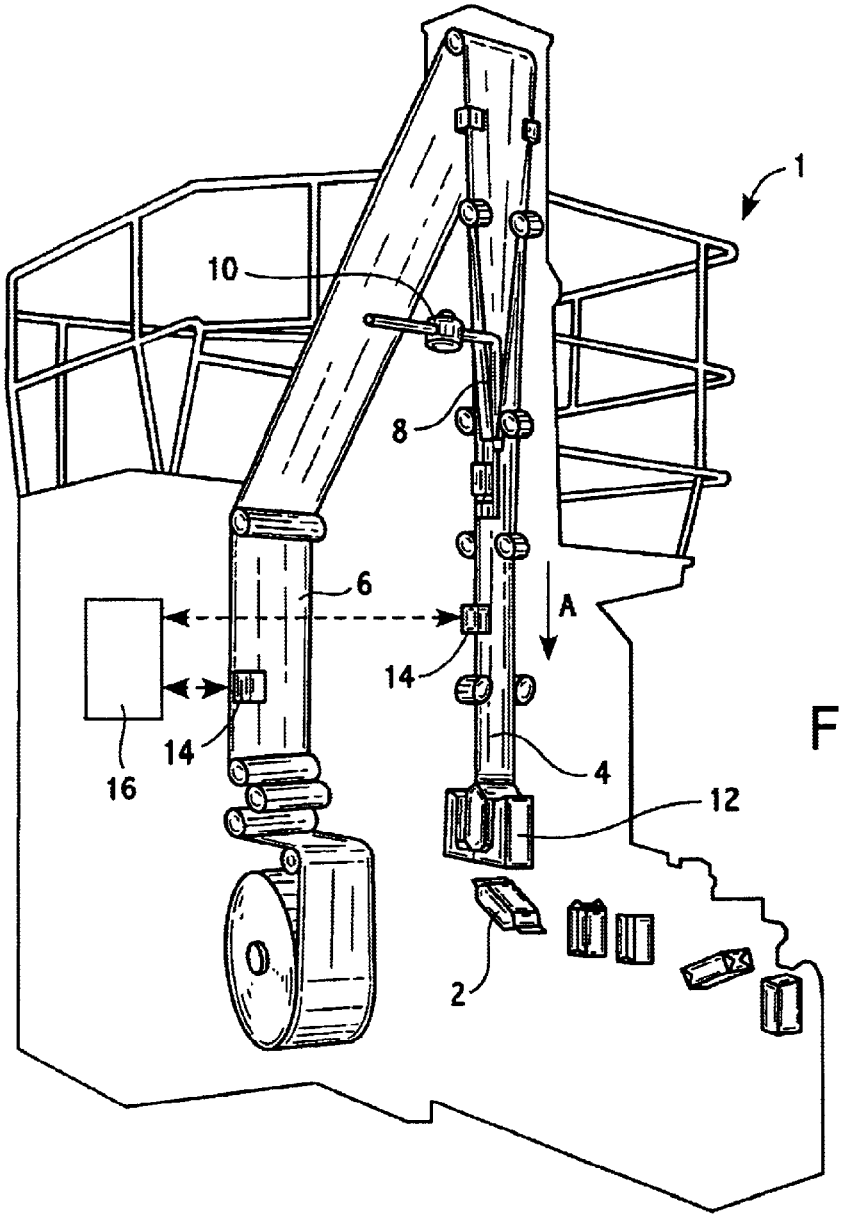
FIG. 1 shows a view in perspective, with parts removed for clarity, of a packaging machine for continuously producing aseptic sealed packages of pourable food products from a tube of packaging material.

Number 1 in FIG. 1 indicates as a whole a packaging machine for continuously producing sealed packages 2 of a pourable food product, such as pasteurized or UHT milk, fruit juice, wine, etc., from a tube 4 of packaging material.

The packaging material has a multilayer structure, and comprises a layer of fibrous material, normally paper, covered on both sides with respective layers of heat-seal plastic material, e.g. polyethylene.

Tube 4 is formed, in known manner not described in detail, by longitudinally folding and sealing a strip 6 of heat-seal sheet packaging material; is filled with the sterilized or sterile-processed food product by means of a fill conduit 8 extending inside tube 4 and having a flow regulating solenoid valve 10; and is fed by known devices along a vertical path A to a forming station 12, where it is cut transversely and folded mechanically to form packages 2.

Packaging machine 1 also comprises a number of photocells 14, which are located along the path of strip 6 of packaging material, are positioned facing strip 6, are held in position by respective supporting members not shown, and are connected to a control unit 16 for controlling packaging machine 1.

More specifically, photocells 14 are arranged in pairs along strip 6 of packaging material to read pairs of side by side register codes on strip 6. For the sake of simplicity, however, FIG. 1 shows only two photocells 14 forming part of different pairs.

Photocell operating parameters can be set either in remote mode—i.e. by means of a signal from the control unit to an input on the photocell or by implementing a teach-in procedure, which can be enabled either in local mode—i.e. by the operator pressing a button on the photocell—or in centralized or remote mode—i.e. by means of an enable signal from the control unit to said input on the photocell.

These procedures provide for automatically setting or self-setting photocell operating parameters such as: light spot color (red, green, blue) used to detect passage of the register code on the strip of packaging material; static intervention threshold; dynamic intervention threshold; static or dynamic photocell operating mode, whereby passage of the register code is detected respectively by comparing the photocell signal level with the static intervention threshold, or comparing photocell signal variations with the dynamic intervention threshold; signal deviation used to calculate the static and dynamic intervention thresholds, i.e. the variation in the photocell signal level between detection of the register code and detection of the background on which the code is impressed; and the enabled/disabled state of the teach-in procedure enable button.

Figure 2:
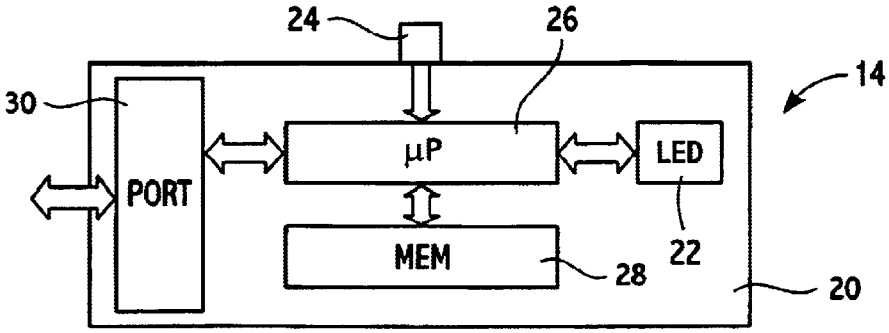
FIG. 2 shows a circuit diagram of a photocell in accordance with the present invention and forming part of the FIG. 1 packaging machine.

FIG. 2 shows the circuit diagram of one of photocells 14.

As shown in FIG. 2, photocell 14 comprises a casing 20 in which are housed a known LED-type light emitting/receiving device 22 not described in detail; a teach-in procedure enable button 24; a microprocessor 26 connected to light emitting/receiving device 22 and enable button 24, and having a respective memory 28; and an input/output port 30 connected to microprocessor 26 and control unit 16, and permitting two-way data and signal exchange between microprocessor 26 and control unit 16 as described in detail later on.

Memory 28 stores the photocell setting parameters mentioned, previously, i.e. the color of the light spot used to detect passage of the register code; the static or dynamic intervention threshold; static or dynamic operating mode; signal deviation; and enabled/disabled state of enable button 24.

Memory 28 can also store data relative to operation and the operating state of photocell 14—such as the total operating time of each LED of light emitting/receiving device 22—to permit preventive LED maintenance or prevent the use of rundown LED s.

Conveniently, input/output port 30 is a communication port preferably of the serial RS232 type implementing a 1200-baud, 8-bit, 1-stop, no-parity protocol and 0–24 V signal dynamics.

Microprocessor 26 is designed to control operation of photocell 14 in different programmed operating modes, and in particular: in automatic sensitivity regulating mode; in local set mode, which can be enabled by either enable button 24 or an enable signal supplied by control unit 16 via input/output port 30; and in different centralized or remote set modes, by which photocell is set directly by control unit 16 via input/output port 30, as described in detail below with reference to the FIGS. 3–6 flow charts.

Figure 3:
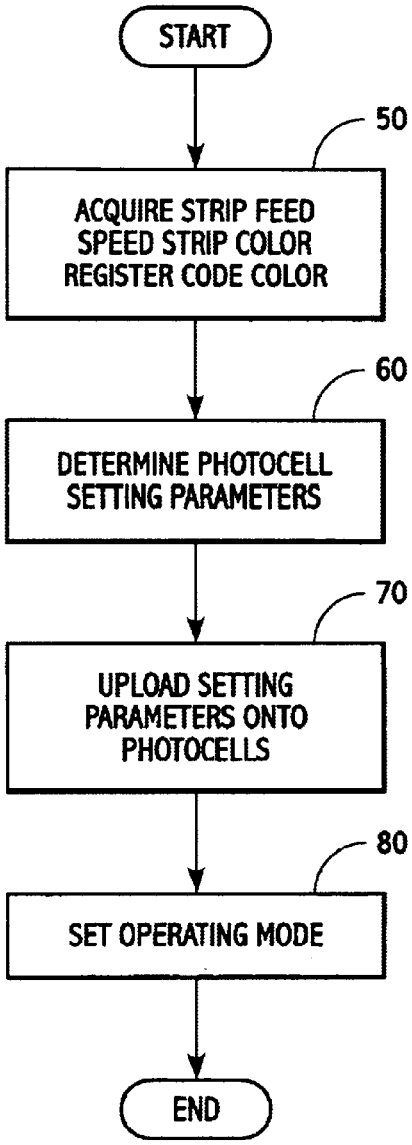
FIGS. 3 to 6 show flow charts of the operations performed to set the FIG. 1 packaging machine photocells.

The FIG. 3 flow chart shows the operations relative to a first photocell set mode, which is implemented when the parameters of strip 6 of packaging material are known beforehand.

More specifically, in the first set mode, the operator—working from a data input device, e.g. a keyboard or a selector, packaging machine 1 is normally equipped with—first enters into control unit 16 the feed speed and color of strip 6 of packaging material, and the color of the register codes on strip 6, or one or more set of pre-set parameters (block 50).

On the basis of the strip parameters entered by the operator, control unit 16 then calculates the setting parameters of photocells 14: in the example shown, the dynamic intervention threshold and the light spot color (block 60).

At this point, control unit 16 uploads onto photocells 14—i.e. supplies photocells 14 with—the calculated setting parameters, which, via respective input/output ports 30, are acquired by respective microprocessors 26 and stored in respective memories 28 (block 70).

Finally, microprocessors 26 set respective photocells 14 to static or dynamic operating mode as a function of the uploaded setting parameters (block 80) A dynamic intervention threshold being uploaded onto photocells 14 in the example shown, microprocessors 26 set photocells 14 to dynamic operating mode.

When the first photocell set mode operations are completed, the photocells commence detecting passage of the register codes using the setting parameters.

Figure 4:
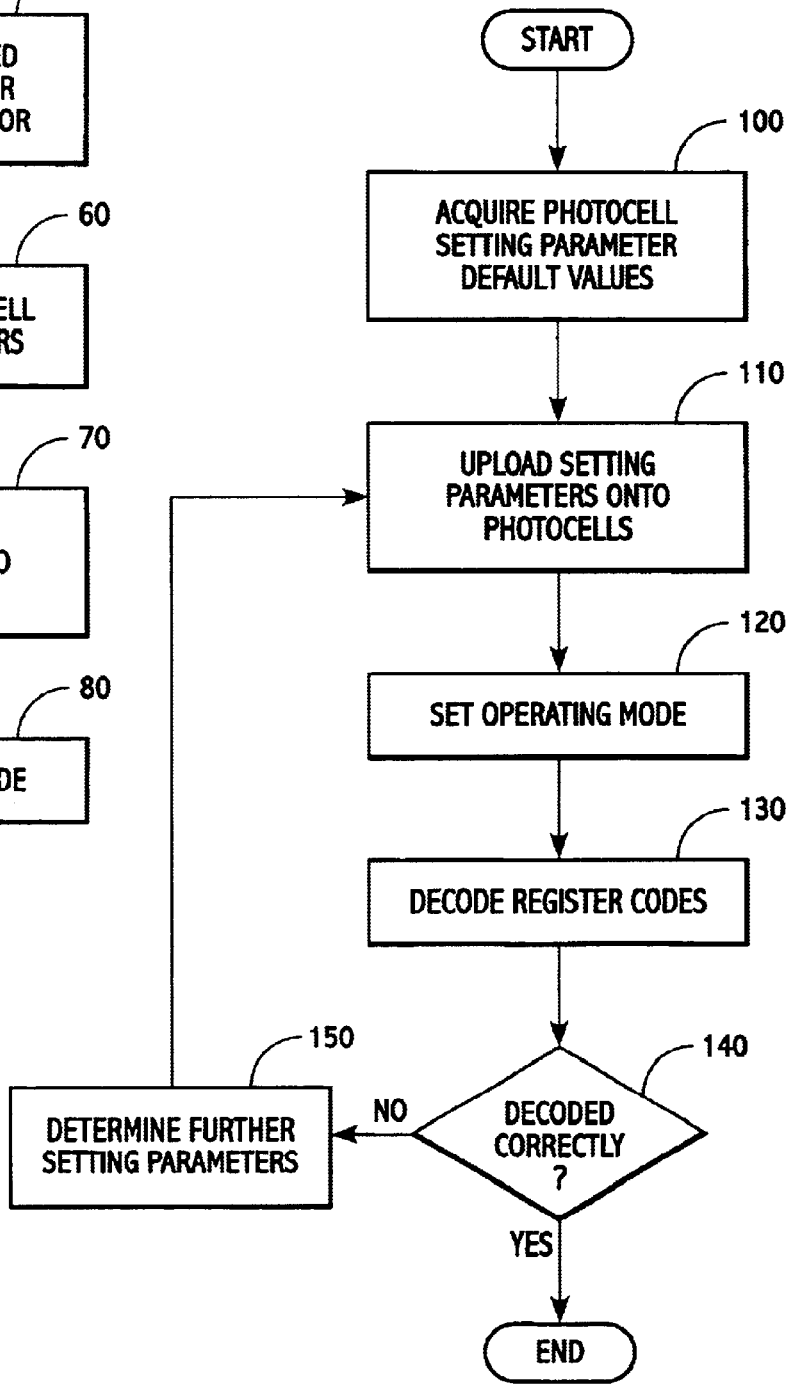

FIG. 4 shows a flow chart of the operations relative to a second photocell set mode, which is implemented by control unit 16 when the parameters of strip 6 of packaging material are not known beforehand.

More specifically, in the second set mode, the control unit 16 first acquires default photocell setting parameter values—in the example shown; default values of the dynamic intervention threshold and light spot color—which may be stored in control unit 16 or entered by the operator from the keyboard (block 100).

Control unit 16 then uploads the setting parameters onto photocells 14 (block 110), and microprocessors 26 set respective photocells 14 to corresponding operating modes (block 120).

At this point, control unit 16 feeds strip 6 of packaging material forward, begins acquiring the signals from photocells 14 relative to the passage of the register codes on strip 6 of packaging material, and decodes the register codes (block 130).

Control unit 16 then determines, in known manner not described in detail, whether the register codes have been decoded properly (block 140).

If the register codes have been decoded properly (YES output of block 140), this marks the end of the second photocell set mode; conversely (NO output of block 140), control unit 16 determines further photocell setting parameter values (block 150), and the sequence commences again from block 110.

Figure 5:
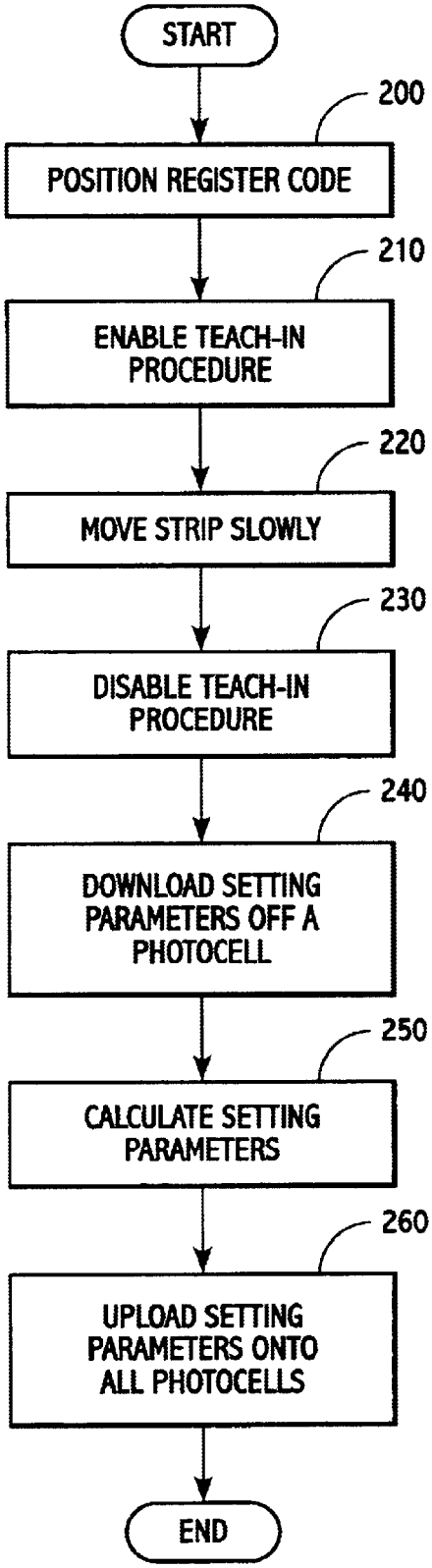

FIG. 5 shows a flow chart of the operations relative to a third photocell set mode, which is implemented by control unit 16 when the parameters of strip 6 of packaging material are not known beforehand.

More specifically, in the third set mode, control unit 16 first runs strip 6 of packaging material to position a register code just before a specific photocell 14 (block 200).

At this point, control unit 16 enables the teach-in procedure of the specific photocell 14 by supplying the respective microprocessor 26 with an enable signal via input/output port 30 (block 210).

At the same time, control unit 16 runs strip 6 of packaging material slowly and acquires the signal supplied by the specific photocell 14 relative to passage of the register code (block 220).

Once passage of the register code is detected, control unit 16 interrupts the teach-in procedure of the specific photocell 14 by supplying a disable signal to respective microprocessor 26 via input/output port 30 (block 230).

At this point, control unit 16 downloads off specific photocell 14 the photocell setting parameters generated by the teach-in procedure—in particular, the static intervention threshold, the signal deviation and the light spot color—(block 240). Control unit 16 processes the downloaded setting parameters, and in particular, calculates the dynamic intervention threshold and the light spot color (block 250), and then uploads the calculated setting parameters onto all the photocells 14 of the packaging machine 1, including specific photocell 14 from which setting parameters were downloaded (block 260).

This marks the end of the third photocell set mode operations.

Figure 6:
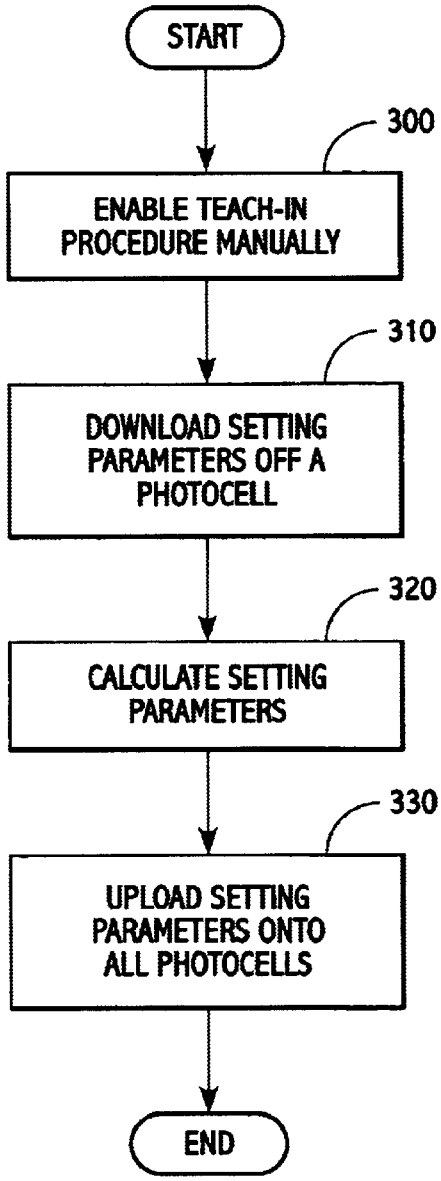

FIG. 6 shows a flow chart of the operations relative to a fourth photocell set mode, which is implemented by control unit 16 when the parameters of strip 6 of packaging material are not known beforehand.

In the fourth set mode, the operator first enables the teach-in procedure of a specific photocell 14 manually by pressing the respective enable button 24 (block 300).

This requires that a register code be fed past the photocell, which is done by the operator either moving the strip of packaging material manually, or using a register code impressed on a separate sheet of paper.

Once the teach-in procedure is completed, control unit 16 downloads off specific photocell 14 the photocell setting parameters generated by the teach-in procedure—in particular, the static intervention threshold, the signal deviation and the light spot color (block 310). Control unit 16 processes the downloaded setting parameters, and in particular, calculates the dynamic intervention threshold and the light spot color (block 320) and then uploads the calculated setting parameters onto all the photocells 14 of the packaging machine 1, including the specific photocell 14 from which setting parameters were downloaded (block 330).

This marks the end of the fourth photocell set mode.

The advantages of the present invention will be clear from the foregoing description.

In particular, equipping each photocell with an input/output port permitting two-way data and signal exchange between control unit 16 and the various photocells provides not only for centralized or remote enabling of the teach-in procedure of each photocell 14, as with known photocells, but also for externally programming the setting parameters of photocells 14 by means of control unit 16 and so eliminating the aforementioned drawbacks of known photocells.

The present invention also provides for eliminating the drawbacks posed by known photocells as regards printing of the packaging material strip.

That is, known photocells require that the register codes be printed on a white background, which means, on the one hand, that one of the four colors typically used in printing the strip of packaging material is used solely for printing the background of the register code, and, on the other, that white must necessarily be included in the printing process.

The present invention, on the other hand, provides for eliminating all the above problems by permitting the reading of register codes impressed on any material or background, even on metalized materials, by simply setting the appropriate light spot color and intervention thresholds of the photocells by means of control unit 16.

What is more, the above advantages are achieved with relatively minor, low-cost alterations to the photocells: costwise, a serial input/output port is negligible with respect to the photocell, and can be incorporated in a traditional photocell with very little difficulty.

Clearly, changes may be made to the photocells as described and illustrated herein without, however, departing from the scope of the present invention defined in the accompanying claims.

What is claimed is:

1. A packaging machine for producing sealed packages of a pourable food product from a sheet packaging material; said packaging machine comprising:

at least one photocell for detecting optically detectable elements on said packaging material, wherein said photocell is programmable externally as regards its photocell operating parameters; and control means connected to said photocell;

wherein said photocell comprises input/output means permitting two-way exchange of photocell operating parameters of the photocell between said control means and said photocell.

2. A packaging machine as claimed in claim 1, wherein said input/output means comprise a serial input/output port.

3. A packaging machine as claimed in claim 1, wherein said control means comprise data downloading means for downloading off said photocell, photocell operating parameters of the photocell.

4. A packaging machine as claimed in claim 3, wherein said control means also comprise data uploading means for uploading photocell operating parameters onto said photocell.

5. A packaging machine as claimed in claim 1, wherein said photocell comprises setting means for setting photocell operating parameters; and wherein enabling means are provided to enable said setting means.

6. A packaging machine as claimed in claim 1, comprising a number of said photocells; and wherein said control means comprise data downloading means for downloading off a specific one of said photocells its photocell operating parameters, and data uploading means for uploading onto at least one of the other photocells photocell operating parameters correlated to the photocell operating parameters downloaded off said specific photocell.

7. A packaging machine as claimed in claim 6, wherein said data uploading means upload said photocell operating parameters onto all the photocells of the packaging machine.

8. A packaging machine as claimed in claim 6, wherein at least said specific photocell comprises setting means for setting photocell operating parameters; and wherein enabling means are provided to enable said setting means.

9. A packaging machine as claimed in claim 1, wherein the photocell operating parameters include a static intervention threshold.

10. A packaging machine as claimed in claim 1, wherein the photocell operating parameters include a dynamic intervention threshold.

11. A packaging machine as claimed in claim 1, wherein the photocell operating parameters include a static photocell operating mode.

12. A packaging machine as claimed in claim 1, wherein the photocell operating parameters include a dynamic photocell operating mode.

13. A packaging machine as claimed in claim 1, wherein the photocell operating parameters include a light spot color.

14. A packaging machine as claimed in claim 1, wherein the photocell operating parameters include a signal deviation.

15. A packaging machine as claimed in claim 1, wherein the photocell operating parameters include an enabled/disabled state of a teach-in procedure.

16. A method of setting photocell operating parameters of a photocell on a packaging machine for producing sealed packages of a pourable food product from a sheet packaging material; comprising the step of programming the photocell operating parameters of said photocell externally; wherein said programming step comprises the step of providing said photocell with input/output means for permitting two-way exchange of photocell operating parameters of the photocell between said photocell and programming means.

17. A setting method as claimed in claim 16, wherein said programming step comprises the step of downloading off said photocell the photocell operating parameters of the photocell.

18. A setting method as claimed in claim 16, wherein said programming step comprises the step of uploading photocell operating parameters onto said photocell.

19. A setting method as claimed in claim 16, wherein said programming step comprises the step of controlling said photocell to enable a setting procedure of the photocell.

20. A setting method as claimed in claim 16, for a packaging machine comprising a number of said photocells; wherein said programming step comprises the steps of downloading off a specific one of said photocells the photocell operating parameters of the photocell, and uploading onto at least one of the other photocells photocell operating parameters correlated to the photocell operating parameters downloaded off said specific photocell.

21. A setting method as claimed in claim 20, wherein said step of uploading onto at least one of the other photocells photocell operating parameters correlated to the photocell operating parameters downloaded off said specific photocell comprises the step of uploading said photocell operating parameters onto all the photocells of said packaging machine.

22. A setting method as claimed in claim 20, wherein said programming step also comprises the step of controlling said specific photocell to enable a setting procedure of the photocell.

23. The method of claim 16, wherein the photocell operating parameters include a static intervention threshold.

24. The method of claim 16, wherein the photocell operating parameters include a dynamic intervention threshold.

25. The method of claim 16, wherein the photocell operating parameters include a static photocell operating mode.

26. The method of claim 16, wherein the photocell operating parameters include a dynamic photocell operating mode.

27. The method of claim 16, wherein the photocell operating parameters include a light spot color.

28. The method of claim 16, wherein the photocell operating parameters include a signal deviation.

29. The method of claim 16, wherein the photocell operating parameters include an enabled/disabled state of a teach-in procedure.

* * * * *